United States Patent [19]

Törneman

[11] Patent Number: 4,496,369

[45] Date of Patent: Jan. 29, 1985

[54] APPARATUS FOR GASIFICATION OF CARBON

[75] Inventor: Björn Törneman, Vësterås, Sweden

[73] Assignee: IPS Interproject Service AB, Stockholm, Sweden

[21] Appl. No.: 505,985

[22] Filed: Jun. 20, 1983

[30] Foreign Application Priority Data

Jul. 1, 1982 [SE] Sweden ..... 8204089

[51] Int. Cl.[3] ..... C10J 3/68; C21C 5/40

[52] U.S. Cl. ..... 48/92; 48/DIG. 2; 266/155; 266/157

[58] Field of Search ..... 48/92, 62 R, DIG. 2; 266/155, 157, 195; 75/0.5 BA, 24

[56] References Cited

U.S. PATENT DOCUMENTS

| | | | |
|---|---|---|---|
| 4,050,683 | 9/1977 | Langhammer | 266/195 X |
| 4,190,237 | 2/1980 | Baum | 266/157 X |
| 4,218,241 | 8/1980 | Hegemann et al. | 266/157 X |
| 4,344,773 | 8/1982 | Paschen et al. | 48/92 |

FOREIGN PATENT DOCUMENTS

| | | | |
|---|---|---|---|
| 296811 | 5/1971 | U.S.S.R. | 266/155 |

*Primary Examiner*—Jay H. Woo
*Assistant Examiner*—Joye L. Woodard
*Attorney, Agent, or Firm*—Silverman, Cass & Singer, Ltd.

[57] ABSTRACT

Apparatus for gasification of carbon (C) in the form of carbon, hydrocarbons and/or hydrocarbon compounds, comprising a reactor (1) into which injection of carbon, oxygen gas and iron oxides takes place, beneath the surface of an iron melt, and in which carbon is injected in stoichiometric excess in relation to the amount of oxygen in the form of oxidic compounds contained in the melt, the reactor having a total inner pressure exceeding atmospheric pressure.

According to the invention an exhaust gas pipe (6) from a reactor (1) makes a gas-tight connection with a cooler (8), which together with the reactor (1) forms a sealed unit; and a regulating valve (13) for adjusting and maintaining an overpressure in said unit is provided and placed on the cool side (12) of the cooler (8).

4 Claims, 5 Drawing Figures

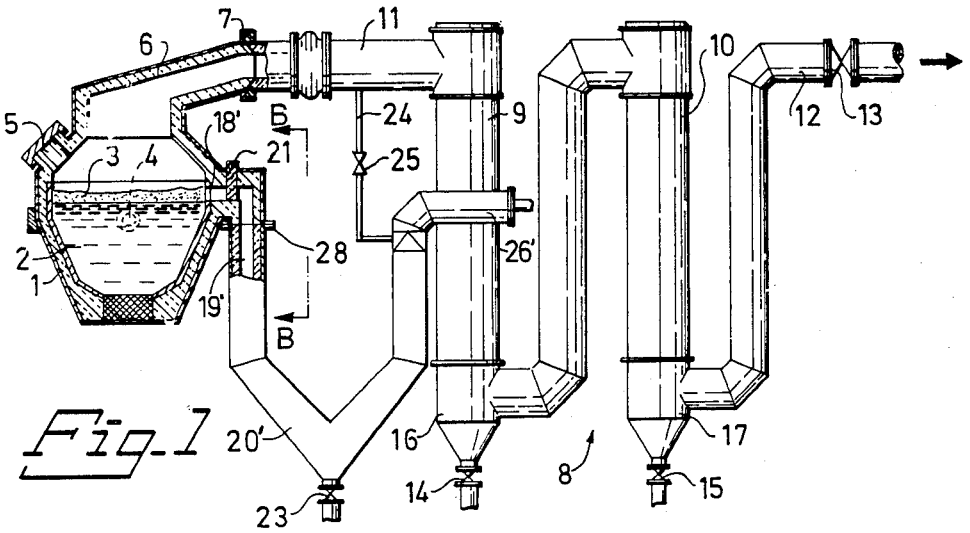
Fig. 1
Fig. 2
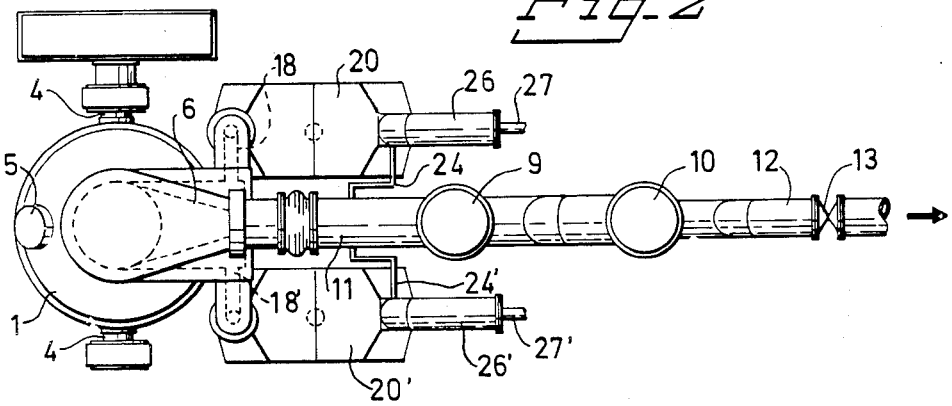
Fig. 3
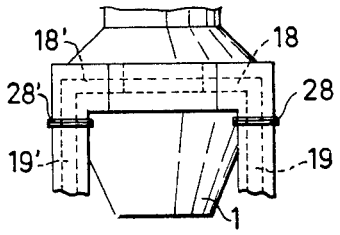
Fig. 4
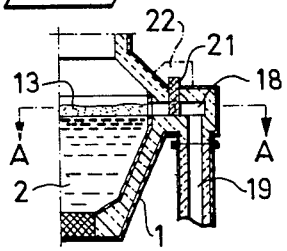
Fig. 5
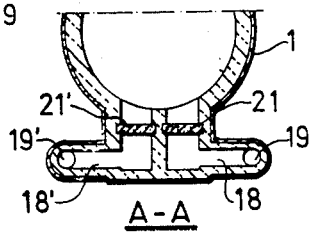

APPARATUS FOR GASIFICATION OF CARBON

The present invention relates to an apparatus for production of gas by gasification of carbon, said apparatus being intended to work at increased pressure.

More specifically the invention relates to an apparatus for production of gas by gasification of carbon in an iron melt into which carbon, oxygen and iron-ore concentrate are injected, carbon being injected in stoichiometric excess in relation to the oxygen in the form of oxide compounds contained in the melt. A gas is then formed, substantially comprising carbon monoxide (CO) and hydrogen ($H_2$).

Swedish Patent (Swedish patent application No. 7706876-5) describes such a process for production of gas, in which gas as well as crude iron are produced. It is in fact highly advantageous to use iron-ore concentrate as a cooling medium, and replace the melt of metals by continuous or intermittent discharge of melt and slag, whereby the sulphur content in the bath as well as the presence of other contaminants may be kept at a favourably low level.

Swedish Patent (Swedish patent application No. 8103201-3) describes a process in gasification of carbon in the form of carbon, hydrocarbons and/or hydrocarbon compounds, whereby carbon, oxygen and iron oxides, in which the iron oxides act as a cooling medium, are injected into the reactor, containing an iron melt, beneath the surface of the melt. Carbon is injected in stoichiometric excess in relation to the oxygen contained in the melt in the form of oxides. The iron melt has a carbon content such that it dissolves carbon. According to the process the reactor is brought to a total inner pressure of 2 to 50 bar, preferably 4 to 10 bar.

By applying a pressure in the reactor the gas production and the production of crude iron increase, compared to when atmospheric pressure prevails. Further, the amount of dust as well as the consumption of lining decrease substantially.

It is difficult to maintain overpressure in a reactor of the kind used here, especially when a discharge of slag and crude iron is to take place at the same time. In order to reduce dust formation and other unwanted effects the sulphur content should be adjusted to lie within the range 0.5% to 2.5%. The sulphur content is controlled by injecting slag forming compounds. The slag formed by the injection of slag forming compounds should be discharged during operation so that the amount of slag does not become too large. The temperature of the gas produced is high, approximately 1300° C. to 1400° C. (2372° F. to 2552° F.), which also makes it extremely difficult to control the pressure in the reactor.

The present invention relates to an apparatus for carrying out the last-mentioned process, i.e. an apparatus for production of gas and crude iron under increased pressure.

This invention thus relates to an apparatus for gasification of carbon (C) in the form of carbon, hydrocarbons and/or hydrocarbon compounds, comprising a reactor in which injection of carbon, oxygen gas and iron oxides takes place under the surface of the iron melt, and in which carbon is injected in stoichiometric excess in relation to the amount of oxygen in the form of oxide compounds in the melt, the reactor having a total inner pressure exceeding atmospheric pressure. The invention is further characterized in that an exhaust gas pipe from the reactor is closely attached to a cooling device, which together with the reactor forms a sealed unit and in that a regulating valve for controlling and maintaining overpressure in the said unit is placed on the cold side of the cooling device.

The invention will now be further described with reference to an embodiment shown in the attached drawing, where FIG. 1 is a side view of an apparatus according to the invention, the reactor being shown in cross-section FIG. 2 shows from above the apparatus seen in FIG. 1

FIG. 3 is a partial view, seen in the direction of the arrows B in FIG. 1

FIG. 4 is a section of the right-hand half in FIG. 3

FIG. 5 is a horizontal section along line A—A in FIG. 4

FIG. 1 shows a reactor 1, lined and provided with a steel mantle, which during operation contains a crude iron melt 2. In FIG. 1, 3 represents slag floating on top of the crude iron melt. The reactor 1 is preferably designed to be tilted round an axis 4 for discharge of crude iron 2 through opening 5.

Carbon, iron-ore concentrate, oxygen and slag-forming compounds are injected by means of conventional lances and/or injection pipes.

In the top of the reactor 1 there is an exhaust gas pipe 6 for the gas produced, which is connected by a gas-tight coupling 7 to a device in the direction in which the gas is transported. This device comprises a cooler, generally represented by 8, which according to this embodiment comprises two conventional steam boilers 9,10. According to a preferred embodiment the cooler contains a dust separator.

The gas produced is thus led through the pipe 6 and another pipe 11 to the first boiler 9. The gas is then led to the second of the two boilers, 10, and on to a discharge pipe 12.

The discharge pipe is provided with a regulating valve 13 for controlling and maintaining the pressure in the reactor and the cooler 8. The regulating valve 13 is of any suitale kind.

As the gas in the outlet pipe 12 has a considerably lower temperature than before it reaches the cooler, e.g. a temperature of approximately 200° C. (392° F.) a quite conventional regulating valve and conventional pressure units may be used. It is thus possible to avoid the considerable difficulties that would arise if the pressure had to be adjusted on the hot side, i.e. in direct connection with the exhaust gas pipe 6 from the reactor, where the temperature of the exhaust gas is approximately 1300° C. to 1400° C. (2372° F. to 2552° F.).

As the pressure is adjusted after the cooler 8, this cooler is maintained under pressure and is thus designed to resist any increased pressure in the system.

Dust that has been separated is discharged through valves 14,15 at the bottom of the dust deparators 16,17.

As mentioned above it is desirable to be able to tap off slag 3 during operation, i.e. whilst the reactor 1 is pressurized. According to the invention there is a device for tapping slag for this purpose, which is also pressurized at a pressure corresponding to the pressure in the reactor. The device for tapping slag comprises a horizontal slag channel 18 at the same level as the desired slag height, leading to a descending slag channel 19. The channel 19 is connected to a granulator 20.

In the horizontal channel 18 there is a flooding valve comprising a stone 21 or a board of a suitable material which in its lower end position closes the slag channel between the reactor and the granulator 20 (See FIG. 4) and which in its raised position opens the channel mentioned. The stone 21 is sealed to the walls of the slag channel by means of devices not shown. A sealed housing 22 which is marked with dashes in FIG. 4 is placed, according to one embodiment, above the stone 21. This housing may also comprise a control, not shown, for positioning the stone 21.

When the level of the slag in the reactor reaches the level of the horizontal slag channel 18, the stone 21 will be pushed upwards and slag will run out of the reactor 1 down to the granulator 20. In order to equalize the pressure in the granulator 20 both at this stage and when granulated material is discharged through a valve 23 at the bottom of the granulator, a pressure equalizing pipe 24 which includes a regulating valve 25 is provided. This pipe 24 connects the granulator 20 with the above-mentioned pipe 11, which leads gas away from the reactor 1.

With wet granulation, hydrogen sulfide ($H_2S$) is formed which is allowed to leave the granulator through a pipe 26. This pipe 26 is also provided with a regulating valve 27 for maintaining pressure in the granulator 20.

In order to enable discharge of crude iron during operation there is a channel 18',19' which corresponds to the above-mentioned channel 18,19 and which connects the reactor with a second granulator 20' for granulation of crude iron. This channel 18' is also provided with a flooding valve in the form of a stone 21' or a board which operates in the same way as the previously mentioned flooding valve 21. This second granulator 20' is pressurized and connected to said further pipe 11 by a pressure equalizing pipe 24'. A pipe 26' and a regulating valve 27' are also provided for discharging the gases produced to the atmosphere.

The horizontal channels 18,18' and the stones 21,21' are fitted in or adjacent to the wall of the reactor 1. Thus a very high temperature will prevail at the stones 21,21', which will eliminate freezing and blockage by slag and/or crude iron splashes.

Thanks to this and the pressurizing of the granulators 20,20' slag and crude iron can be discharged continuously or intermittently during operation. Further it is not necessary for the stones 21,21' to be designed to deal with pressure differences between the horizontal channels 18,18' and the descending channels 19,19'.

It is evident from FIG. 5 that the channels 18,18' are arranged parallel to each other. In FIG. 3 the channels 18,18' are shown positioned at the same level. The height of the channels 18,18' may, of course, be varied according to the desired slag level and the thickness of the slag layer. In such a case the channel 18' for tapping crude iron is preferably positioned at a lower level than a channel 18 for tapping slag.

The descending channels 19,19' are each provided with a sealed coupling 28,28'. When all the crude iron is to be discharged, these couplings 28,28' are released as well as the coupling 7 on the exhaust gas pipe 6 on the reactor and the reactor is then tilted.

An apparatus according to the present invention must, of course, be adapted to the pressures at which it is to be used. Modifications of valves, seals, design of cooler and the like may be made without departing from the main concept of the invention, which is to pressurize both the reactor and the cooler as well as any other auxiliary equipment, for example the tapping devices for slag and crude iron.

The present invention is thus not limited to the embodiment described above but can be varied within the scope of the attached claims.

I claim:

1. Apparatus for gasification of carbon in the form of carbon, hydrocarbons, or hydrocarbon compounds, under total pressure exceeding atmospheric pressure, comprising:

A. reactor means for containing molten iron, said reactor including injection means for injecting carbon, oxygen gas, and iron oxides beneath the surface of the molten iron, and for injection of carbon in stoichiometric excess relative to the amount of oxygen contained in the molten iron in the form of oxide compounds;

B. an exhaust pipe connected to said reactor means for discharge of exhaust gas therefrom;

C. cooling means for cooling said gas connected to said exhaust pipe to form a sealed unit with said reactor means;

D. valve means for regulating and maintaining pressure greater than atmospheric pressure in said unit, said valve means being positioned on said cooling means;

E. first tapping means for discharge of slag from said reactor means, and second tapping means for discharge of crude iron from said reactor means, each of said first and second tapping means connected to said exhaust pipe by a pressure equalizing pipe, in order to maintain said first and second tapping means at the same pressure as said unit.

2. The apparatus of claim 1, wherein each of said first and second tapping means comprises a granulator means having an inner portion connected to said exhaust pipe.

3. The apparatus of claim 1, wherein each of said first and second tapping means comprises a horizontal channel connected to said reactor means for discharge therethrough of slag and crude iron, respectively, said channel including a flooding valve comprising a valve member for opening and closing said channel.

4. The apparatus of claim 1, wherein said cooling means comprises at least one steam boiler connected to at least one dust separator means.

* * * * *